US006050840A

United States Patent [19]

Kowalski et al.

[11] Patent Number: 6,050,840

[45] Date of Patent: Apr. 18, 2000

[54] ELECTRICAL PLUG

[75] Inventors: Wayne J. Kowalski, Buffalo Grove; Robert J. Holpuch, Arlington Heights, both of Ill.

[73] Assignee: Coleman Cable Systems, Inc., North Chicago, Ill.

[21] Appl. No.: 08/908,838

[22] Filed: Aug. 8, 1997

[51] Int. Cl.[7] ..... H01R 13/62

[52] U.S. Cl. ..... 439/369; 439/502; 439/371; 439/456

[58] Field of Search ..... 439/369, 449, 439/502, 308, 309, 451, 452, 370, 371, 372, 456, 457, 458

[56] References Cited

U.S. PATENT DOCUMENTS

| | | | |
|---|---|---|---|
| D. 266,559 | 10/1982 | Gibbs | D13/28 |
| D. 306,282 | 2/1990 | Arehart et al. | D13/28 |
| D. 332,937 | 2/1993 | Priest et al. | D13/138 |
| 2,672,594 | 3/1954 | Morton | 439/369 |
| 3,764,395 | 10/1973 | Boyle | 439/309 |
| 4,167,301 | 9/1979 | Mundschenk | 439/457 |
| 5,006,960 | 4/1991 | Kallin et al. | 361/390 |
| 5,171,155 | 12/1992 | Mendoza | 439/134 |
| 5,620,333 | 4/1997 | Boyle | 439/471 |

*Primary Examiner*—Renee S. Luebke
*Assistant Examiner*—Hae Moon Hyeon
*Attorney, Agent, or Firm*—Rudnick & Wolfe

[57] ABSTRACT

An electrical plug designed to inhibit another electrical plug, mated or joined thereto, from becoming inadvertently separated as a result of pulling forces being exerted on an electrical cord extending from the other electrical plug. The salient feature of the invention is an electricfiable plug body which contains a strain relief for releasably securing or griping a lengthwise portion of a second electrical cord to the plug body thereby maintaining the electric connection between the electrical contacts of the plug body and the electrical cord when tensile or pulling forces are exerted. The strain relief comprises a series of tines extending from the plug body which combine to define a circuitous path of travel for the lengthwise portion of the second electrical cord secured by the stain relief. The surfaces of the tines define an elongated groove, arranged adjacent to the plug body, which accommodates the lengthwise portion of the second electrical cord therebetween.

36 Claims, 5 Drawing Sheets

ELECTRICAL PLUG

FIELD OF THE INVENTION

The present invention relates to electrical devices and, more particularly, to an electrical plug designed to inhibit another electrical plug, mated or joined thereto, from becoming inadvertently separated as a result of pulling forces being inadvertently exerted on an electrical cord extending from the other electrical plug.

BACKGROUND OF THE INVENTION

Electrical plugs are in common use with electrical cords or conduits and power supply cords. Typically, the electrical plugs have two or more electrical contacts which are mated or joined to each other. For example, an electric tool usually has a relatively short length electrical cord extending therefrom with an electric plug at the end thereof. The plug at the end of the electrical tool cord or conduit typically has a socket with at least two spring-like electrical female contacts adapted to releasably receive and electrically mate with two male elongated prongs or contacts extending from an electrical plug commonly disposed at the end of an elongated power supply cord.

The contact force established between the spring-like electrical female contacts in the socket in one electrical plug and the male conductive pins of the other electric plug is all that secures the electrical plugs to each other. As will be appreciated by most everyone who uses electrically powered tools, such as saws, drills and outdoor gardening equipment, the force holding the electrical plugs together are easily overcome during use thereby resulting in inadvertent separation of the plugs from each other.

The inadvertent separation of the electrical plugs establishing an electrical connection between, for example, an extension cord and a tool or the like is of particular concern in construction sites. In these applications, a worker can lose all power due to a plug inadvertently separating from a cord connector located a significant distance away from the location whereat the worker is presently disposed. Thus, when there is an inadvertent separation of an electrical plug from a cord connector, the worker must cease what he is doing to effect connection of the tool to the power source. This results in a loss of valuable time. Moreover, requiring a worker to move across a work site to connect an inadvertently disconnected electrical tool from a cord connector increases the likelihood of accidents and other inadvertent mishappenings.

Heretofore, the most common remedy is to tie a knot in the cord, thus holding the plug into the cord connector. This purported solution, however, has not always met with the greatest success. As will be appreciated, to tie the electrical connection together, applies potentially destructive forces to the electrical cords. This often results in a fire or shock hazard.

Thus, there is a continuing need and desire for some form of means for precluding inadvertent separation of a pair of electrical plugs forming an electrical connection between two electrical cords or conductors upon the application of a separating or pulling force inadvertently exerted on either cord or conductor.

SUMMARY OF THE INVENTION

As used herein and throughout, the term or phrase "plug" is intended to denote a male or female electrical connector. Moreover, and as used herein and throughout, the term or phrase "electrical conductor" or "electrical cord" is intended to intended to denote either an attachment cord or a supply cord.

In view of the above, and in accordance with the present invention, there is provided an electrical plug configured for inhibiting inadvertent separation of an electrical cord releasably connected thereto. The electrical plug includes an electrifiable plug body having electrical contacts to which the electrical cord is to be releasably connected.

According to one aspect of the present invention, the plug body includes, as part thereof, a strain relief for releasably securing or gripping a lengthwise portion of the electrical cord to the plug body thereby maintaining the electric connection between the electrical contacts of the plug body and the electrical cord. Thus, tensile or pulling forces exerted on the electrical cord have a significantly reduced effect on the electrical connection between the electrical cord and the plug body.

In one form of the invention, the strain relief on the plug body comprises a series of tines extending from the plug body and which combine to define a circuitous path of travel for the lengthwise portion of electrical cord secured or gripped by the strain relief. Surfaces on the tines projecting from the plug body define an elongated groove or channel arranged adjacent the plug body. The elongated channel or groove defined by the tines and on the plug body accommodates the lengthwise portion of the electrical cord therebetween. As will be appreciated, the channel defined by the surfaces on the tines are sized and arranged relative to each other to grip an exterior of the lengthwise portion of the electrical cord therebetween. In a preferred form of the invention, the tines are integrally formed with the plug body.

In a most preferred form of the invention, the channel defined in the plug body includes ingress and egress portions disposed substantially coplanar or in alignment relative to each other. The channel defined by the tines on the plug body further includes an midportion which is offset from the ingress and egress end portions such that the lengthwise portion of the electrical cord passing through the channel has a V-like configuration thereto and is inhibited from endwise movement through the channel when a tensile or pulling forces is exerted thereon.

The plug body of the electrical plug further includes structure for holding the lengthwise portion of the electrical cord adjacent the plug body. Moreover, the plug body of the electrical plug according to the present invention further includes structure for releasably holding the lengthwise portion of the electrical cord within the channel. The structure for holding the lengthwise portion of the electrical cord adjacent the plug body and the structure for releasably holding the lengthwise portion of the electrical cord within the channel are preferably formed integrally with plug body.

In another form of the invention, the strain relief on the plug body is configured to releasably accommodate two electrical cords passing therethrough in side-by-side relationship relative to each other. Alternatively, the plug body of the electrical plug of the present invention can include a second strain relief for accommodating a lengthwise portion of another electrical cord. The second strain relief is configured such that a lengthwise portion of the additional cord passes therethrough and is inhibited from moving endwise through the strain relief when a pulling force is exerted thereon.

To effect an electrical connection between the electrified plug body and the electrical cord, the plug body further includes at least two electrical contacts thereon. As will be appreciated by those skilled in the art, the electrical contacts are elongated in a predetermined direction relative to the plug body. In a preferred form of the invention, the lengthwise portion of the electrical cord passing through the strain relief passes along a path extending generally parallel to the lengthwise direction of the electrical contacts. As such, a loop is formed in that portion of the electrical cord passing between the outlet end portion of the strain relief and the electrical plug on the electrical cord after the electrical plug is mated with the plug body. As will be appreciated, the loop in the electrical cord furthermore inhibits inadvertent separation of the electrical connection established between the electrical cord and the plug body of the electrical plug of the present invention.

Another salient feature of the present invention relates to an electrical connection when an electrical plug of the present invention is electrically joined to another electrical plug having an electrical cord extending therefrom. This aspect of the present invention involves having a male plug with a first electrical cord extending from one side thereof and a plurality of conductive pins extending therefrom in diametrically opposed relationship to said cord and from an opposite side thereof and a female plug having a second electrical cord extending therefrom, said second plug including a plug body with a peripheral edge extending thereabout, and with the second electrical cord extending away from the peripheral edge of the second plug along a predetermined path, and wherein the female plug further includes a socket for releasably accommodating the conductive pins of the male plug. In this form of the invention the second electrical cord and the socket on the female plug are separated by an included angle of less than 180°. As such, the male and female plugs are retained in mating relation relative to each other against pulling forces exerted on the first and second electrical cords that would normally cause separation of the plugs.

Alternatively, the plug assembly of the present invention could include a male plug having a first electrical cord extending from one side thereof and a plurality of conductive pins extending therefrom in diametrically opposed relationship to the cord and from an opposite side thereof and a female plug having a second electrical cord extending therefrom. The second plug includes a plug body with a peripheral edge extending thereabout, and with the second electrical cord extending away from the peripheral edge of said second plug along a predetermined path, and wherein the female plug further includes a socket for releasably accommodating the conductive pins of the male plug. In this form of the invention, the the second electrical cord and the socket on the female plug are separated by an included angle of less than 180°. Accordingly, male and female plugs are retained in mating relation relative to each other against pulling forces exerted on the first and second electrical cords that would normally cause separation of the plugs.

These and other objects, aims, and advantages of the present invention will become more readily apparent from the following detailed description of the invention, the claims and the appended drawings.

DETAILED DESCRIPTION OF THE DRAWINGS

DESCRIPTION OF THE PRESENT INVENTION

Figure 3:
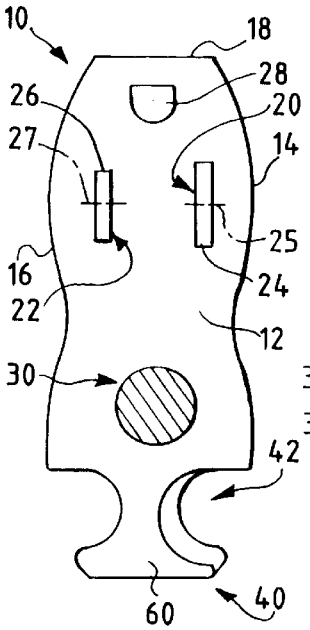
FIG. 3 is an end view of the electrical plug illustrated in FIG. 1.

While the present invention is susceptible of embodiment in various forms, there is shown in the drawings and will hereinafter be described a preferred embodiment of the invention with the understanding that the present disclosure is to be considered as setting forth an exemplification of the invention which is not intended to limit the invention to the specific embodiment illustrated.

Referring now to the drawings, wherein like reference numerals indicate like parts throughout the several views, there is shown an electrical plug according to,the present invention and represented in its entirety by reference numeral 10. The electric plug 10 of the present invention includes a plug body 12 having separated major surfaces 14 and 16. The plug body 12 further includes a peripheral edge 18 adjoining the major surfaces 14 and 16.

In a preferred form of the invention, the plug body 12 is of one-piece molded construction. In a most preferred from of the invention, plug body 12 is formed from a conventional plastic or other suitable form of composite and highly insulative material. As will be appreciated by those skilled in the art, other tough insulative materials would equally suffice to form the preferable one-piece plug body 12.

The electrical plug 10 further includes at least two electrical contacts 20 and 22. In the illustrated form of the invention, and as shown in FIG. 3, the electrical contacts 20, 22 include conventional electrically conductive metal pins 24 and 26 which are relatively rigid in construction. A lengthwise portion of each conductive pin 24, 26 is embedded within the plug body 12 while another rigid linear portion of each pin 24, 26 extends in a first direction away from the plug body 12 of the electric plug 10. Each electrically conductive pin 24, 26 defines an axis 25, 27, respectively, extending generally parallel relative to each other.

Although not specifically illustrated in the drawings, the power pins 24, 26 of the electric plug 10 can be polarized by providing a flared tip or other suitable configuration and a nonflared tip for the other power pin. Of course, other suitable configurations would likewise suffice without detracting or departing from the spirit and scope of the present invention. Moreover, rather than planar configurations, the power pins 24, 26 can have an arcuate configuration if so desired. Moreover, and as shown in FIG. 3, the electric plug 10 can include a third electrically conductive pin 28 extending generally parallel to the pins 24 and 26 and which serves as a ground connection for the plug 10.

Figure 1:
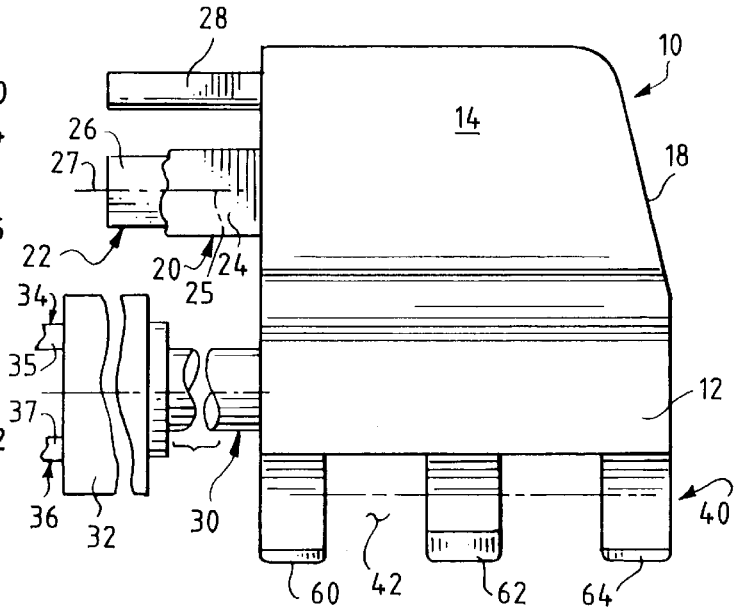
FIG. 1 is a plan view of one form of electrical plug according to the present invention.
Figure 2:
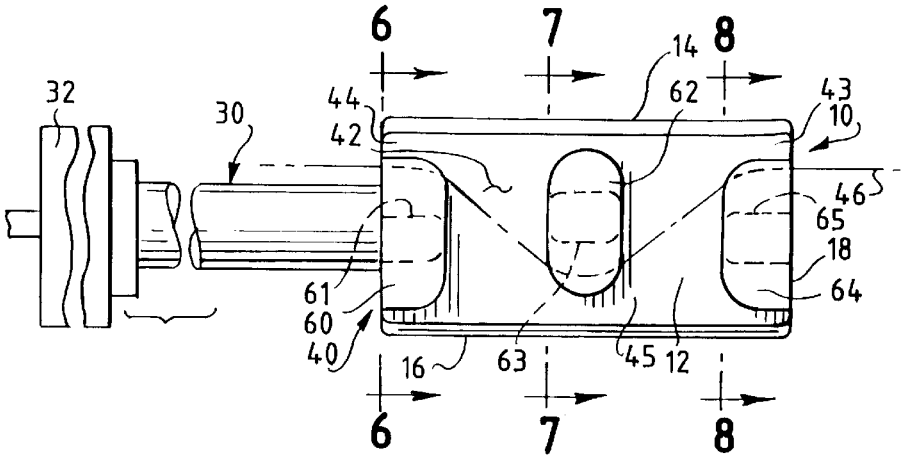
FIG. 2 is a side elevational view of the electrical plug illustrated in FIG. 1.

When the plug 10 is used, the plug body 12 is electrified. In the illustrated form of the invention, the electric plug 10 further includes an insulated and flexible electrical cord 30. One end of the electrical cord 30 is operably connected, in a conventional and well known fashion, to the electrical contacts 20 and 22 of the electric plug 10. As shown in FIGS. 1 and 2, the electrical cord or conductor 30 preferably extends from the peripheral edge 18 of the plug body 12 in the same direction of and generally parallel to the axes 25, 27 of the electrical contacts 20, 22, respectively.

An opposite end of the electrical cord or conductor 30 includes a conventional plug 32. In the illustrated form of the invention, the electric plug 32 includes electrical contacts 34 and 36. Although electrically conductive pins 35 and 37 are illustrated in the drawings, it will be appreciated that a socket (not shown) having electrical contacts 34 and 36 would equally suffice without detracting or departing from the spirit and scope of the present invention.

Figure 4:
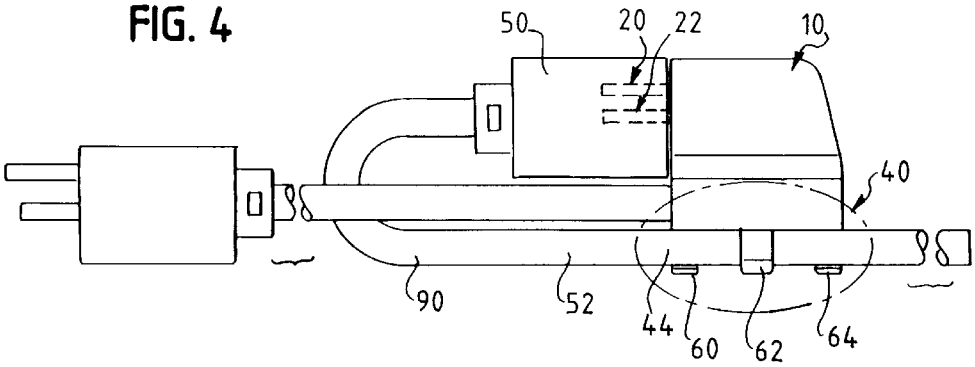
FIG. 4 illustrates an electrical plug assembly including the electrical plug shown in FIG. 1 joined or connected to an electric plug at the end of an electrical cord.
Figure 5:
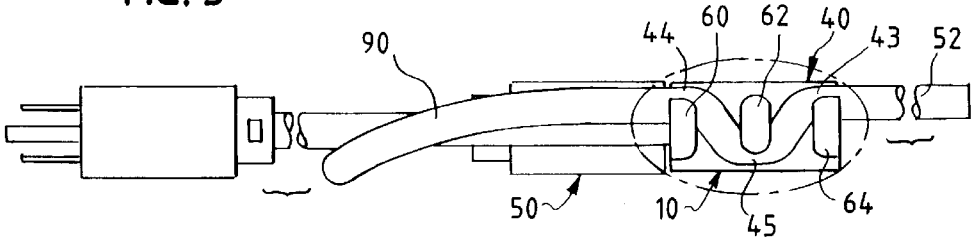
FIG. 5 is a side elevational view of the electrical plug assembly shown in FIG. 4.

A salient feature of the electric plug 10 of the present invention involves the provision of a strain relief 40 arranged in combination with the electric plug 10. As shown in FIGS. 4 and 5, the purpose of the strain relief 40 is to prevent another electrical plug 50 from becoming inadvertently separated from the electric plug 10 after an electric connection is established between the electrical contacts 20, 22 (FIGS. 1 and 3) of electrical plug 10 and the electrical contacts (not shown) of plug 50. That is, after the plugs 10 and 50 are mated, the purpose of the strain relief 40 is to inhibit a pulling or tensile force exerted on a second electrical cord or conductor 52, joined and operably connected to electric plug 50, from having an adverse or separating effect of the electrical connection established between the plugs 10 and 50.

Returning to FIGS. 1 and 2, the strain relief 40 is preferably configured as an open sided and elongated channel or groove 42 defined on the plug body 12 of the electrical plug 10. The elongated channel or groove 42 is sized to accommodate and grip or temporarily secure a lengthwise portion of the second electrical cord 52 (FIGS. 4 and 5) to the plug body 12 of the electric plug 10. The open sided configuration of the channel or groove 42 readily permits insertion of a lengthwise portion of electrical cord 52 thereinto exteriorally of the plug body 12. That is, the plug body 12 does not have to be divided or separated to effect securement of a lengthwise portion of the second cord or conductor 52 to the electric plug 10.

As shown in FIG. 1, the channel or groove 42 has an elongated configuration and is preferably disposed along the peripheral edge 18 of the plug body 12 of electric plug 10. In a most preferred form of the invention, the elongated channel or groove 42 defines a path extending generally parallel to the axes 25, 27 of the electrical contacts 20, 22, respectively, and preferably extends parallel to that portion of the electrical cord or conductor 30 projecting immediately away from the plug body 12 of plug 10.

As shown in FIG. 2, the channel 42 is specifically configured to inhibit the lengthwise portion of cord or cable 52 inserted thereunto from passing endwise through the channel 42 in response to a tensile or pulling force being exerted on the cord 52. The elongated groove or channel 42 includes an inlet portion 43 and an outlet portion 44. Moreover, the elongated channel 42 forming the strain relief 40 further includes a midportion 45.

As shown in FIG. 2, the inlet and outlet portions 43 and 44, respectively, of the channel 42 are preferably arranged in general alignment relative to each other. Stated otherwise, the inlet and outlet portions 43 and 44, respectively, of channel 42 are preferably coplanar relative to each other. Notably, the midportion 45 of channel 42 is offset from either the inlet portion 43 or the outlet portion 44 of the channel 42. The offset relationship of the midportion 45 of channel relative to opposite ends 43, 44 thereof defines a circuitous path 46 for the lengthwise portion of cable 52 inserted therewithin. That is, and after being inserted within the strain relief 40, the lengthwise portion of cord 52 disposed between the inlet portion 43 and outlet portion 44 of channel 42 is forced into a circuitous configuration.

Turning again to FIGS. 1 and 2, the strain relief 40 on the plug body 12 of the electric plug 10 preferably includes a series of tines or extensions 60, 62 and 64 projecting from the peripheral edge 18 of the plug body 12 of plug 10. As will be appreciated, and in combination with each other, the tines or extensions 60, 62 and 64 define the circuitous path 46 of channel 42 on the plug body 12 and into which a lengthwise portion of the second electrical cord or conductor 52 is entrapped against lengthwise movement.

The tines or extensions 60, 62 and 64 are relative rigid in construction to withstand the rugged environment in which the electric plug 10 can find utility. In a most preferred from of the invention, the tines or extensions 60, 62 and 64 are formed integral with or as part of the plug body 12.

As shown in FIG. 2, surfaces 61 and 65 on tines 60 and 64, respectively, and opposing surface 63 on tine 62 operationally serve to frictionally engage and grip the outer surface configuration of the lengthwise portion of the electrical conductor or cord 52 adapted to be engaged by strain relief 40. Moreover, and as will be appreciated from a proper understanding of the present invention, the opposed surfaces 61, 63 and 65 of tines 60, 62 and 64, respectively, are sized and arranged relative to each other to frictionally grip the outer surface of the second cord or cable 52 therebetween.

Figure 6:
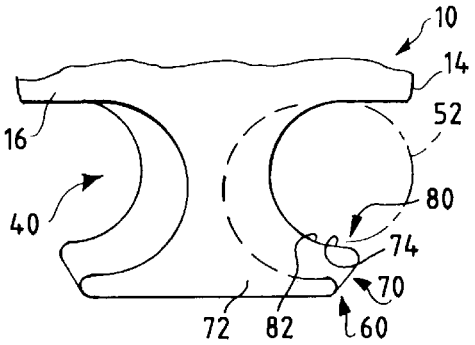
FIG. 6 is a view taken along line 6—6 of FIG. 2.
Figure 7:
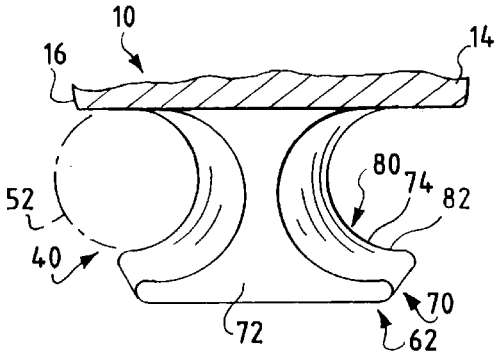
FIG. 7 is a view taken along line 7—7 of FIG. 2.
Figure 8:
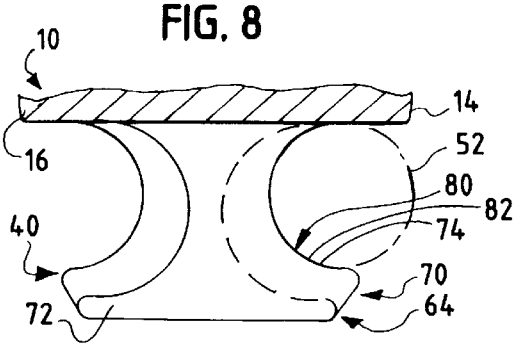
FIG. 8 is a view taken along line 8—8 of FIG. 2.

The electrical plug 10 of the present invention further includes structure 70 for releasably holding the lengthwise portion of the second cord or conductor 52 within the strain relief 40. As illustrated in FIGS. 6, 7 and 8, structure 70 comprises a flange-like formation 72 at the distal end of each tine or extension 60, 62 and 64. Notably, a predetermined distance is established between an interior surface 74 of each flange-like formation 72 on distal end of the tines 60, 62 and 64 and the peripheral edge 18 of the plug body 12.

In a preferred form of the invention, the predetermined distance between the flange-like formation 72 at the distal end of each tine 60, 62 and 64 varies from tine to tine. That is, and in a most preferred form of the invention, the predetermined distance separating the flange-like formation 72 at the end of tine 60 can be more or less than the predetermined distance separating the flange-like formation 72 at the distal end of tines 62 and 64. Moreover, the predetermined distance separating the flange-like formation 72 at the distal end of tine 62 is preferably different than the predetermined distance separating the flange-like formation 72 at the distal ends of tines 60 and 64. The differences in the predetermined distances separating the flange-like formations at the ends of the tines 60, 62 and 64 defines the direction that the lengthwise portion of electrical cord or cable 52 directed through the channel 42 of strain relief 40. As will be appreciated, with some manual and purposeful manipulation, the second cord or conductor 52 could be forcefully moved past the structure 70 if so desired to remove or release the lengthwise portion of the second cord or conductor 52 from the strain relief 40 of the electric plug 10.

The electrical plug 10 of the present invention further includes structure 80 for releasably holding the lengthwise portion of the second cord or conductor 52 adjacent the peripheral edge 18 of the plug body 12 of the electrical plug 10 thereby reducing the likelihood the electrical connection between plugs 10 and 50 will become inadvertently separated. As illustrated in FIGS. 6, 7 and 8, structure 80 preferably includes a slanted or curved surface 82 configured at the distal end of each extension or tine 60, 62 and 64. The slanted or chamfered surface 82 is preferably disposed on an interior surface of each flange-like formation 72 on the tines 60, 62 and 64. Suffice it to say, the angled or curved surface 82 of structure 80 is configured to engage and move or urge the lengthwise portion of the second cord or cable 52 entrapped by the strain relief 40 toward the peripheral edge 18 of the plug body 12.

In this form of the invention, and as shown in FIGS. 4 and 5, the electrical plugs 10 and 50 are electrically connected to each other such that the contacts 20, 22 associated with plug 10 are electrically connected to the electrical contacts of plug 50. Moreover, a lengthwise portion of the electrical cord or conductor 52 associated with plug 50 is entrapped within the strain relief 40 of the electric plug 10 thereby preventing inadvertent separation of the plugs 10 and 50.

In the embodiment of the invention illustrated in FIGS. 4 and 5, a lengthwise portion of the electrical cable 52 is entwined with the tines or extensions 60, 62 and 64 of the plug body 12 such that the lengthwise portion of the cord 52 connected to plug 50 is passed through a circuitous path, thus, inhibiting endwise movement of the cord 52 through the strain relief 40 in response to a pulling force or tensile stresses being exerted on the cord 52. More specifically, in the illustrated form of the invention, a portion of cord 52 passes through both the inlet and outlet portions 43 and 44 of the channel 42 of the strain relief 40. It is important to note, however, that between the inlet and outlet portions 43 and 44, a lengthwise portion of the cord or connector 52 is required to be pass around the midportion 45 of the channel 42, thus, inputting a shape to the lengthwise portion of the cord or connector 52 entrapped in the strain relief 40. As such, the frictional engagement of the outside surface of the lengthwise portion of the cord or connector 52 with the opposing surfaces. 61, 63 and 65 defined by the channel or groove 42 inhibits endwise movement of the cord or connector 52 relative to the plug body 12 thereby protecting the electrical connection between the plugs 10 and 50.

As shown in FIG. 4, a portion of cable 52 passes between the outlet portion 44 of the strain relief 40 and the plug 50. In the illustrated form of the invention, the path of travel of the lengthwise portion of cable 52 entrapped by strain relief 40 extends generally parallel with the electrical contacts 20, 22 on the plug 10. Accordingly, a loop 90 is formed in that lengthwise portion of the second cord or conductor 52 passing between the outlet end portion 44 of the strain relief 40 and the plug 10. The provision of a loop 90 furthermore inhibited plugs 10 and 50 from becoming inadvertently separated from each other in response to a pulling force or tensile stresses being imparted to the second cord 52.

Figure 9:
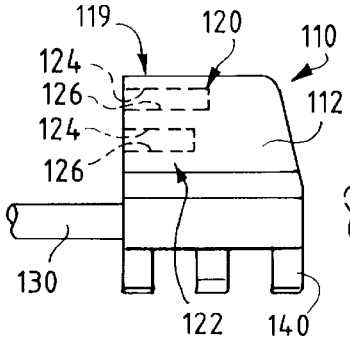
FIG. 9 is a plan view of another form of electrical plug according to the present invention.
Figure 10:
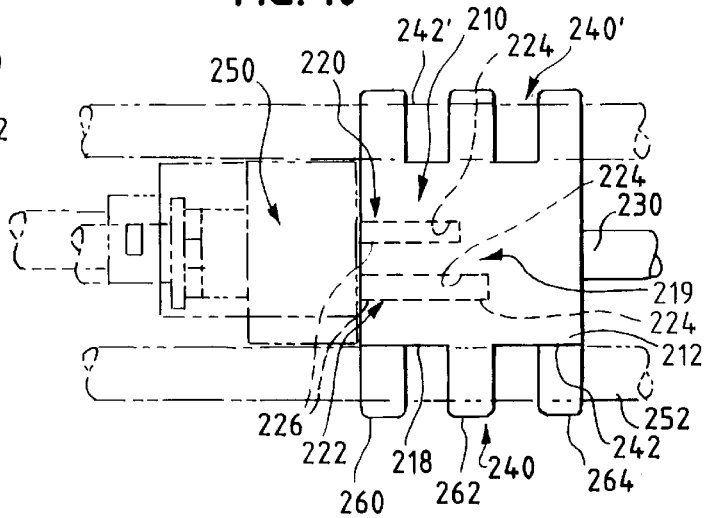
FIG. 10 is a plan view of yet another form of electrical plug according to the present invention.
Figure 11:
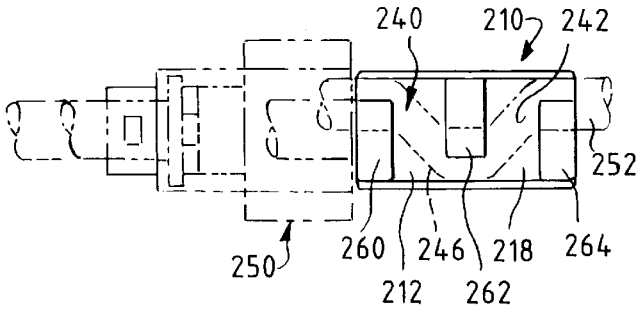
FIG. 11 is a side elevational view of the electrical plug illustrated in FIG. 10.
Figure 12:
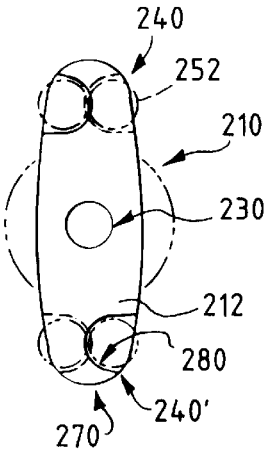
FIG. 12 is a right end elevational view of the electrical plug illustrated in FIG. 10.
Figure 13:
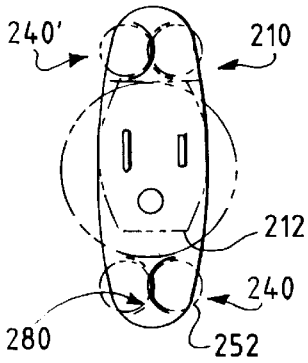
FIG. 13 is a left end elevational view of the electrical plug illustrated in FIG. 10.

Another embodiment of an electrical plug according to the present invention is illustrated in FIG. 9. The alternative form of electrical plug shown in FIG. 9 is designated generally by reference numeral 110. The elements of this alternative from of electrical plug that are identical or functionally analogous to those components mentioned above with respect to electrical plug 10 are designated by reference numerals identical to those used above with the exception that this embodiment uses reference numerals in the 100 series.

The electrical plug 110 includes a plug body 112 substantially similar to that disclosed above regarding plug body 12. In this embodiment of the invention, the plug body defines an electrical socket 119 including electrical contacts 120, 122. Each electrical contact 120, 122 includes conventional electrically conductive members 124 and 126 embedded within the plug body 112 of plug 110. As well known in the art, the members 124, 126 of each electric contact 120, 122 are spring biased toward each other but are separatable from each other when a male conductive pin of another electrical plug is inserted therebetween. The conductive members 124, 126 of each electric contact 120, 122 are operably and electrically connected in a conventional manner to an electrical cord or conductor 130 extending away from the peripheral edge 118 of the plug body 12 of electric plug 110.

The electrical plug 110 further includes a strain relief 140. The strain relief 140 is substantially similar to the strain relief 40 discussed in detail above. Thus, no further detailed description needs to be provided thereto for a complete understanding of the function and operation of strain relief 140.

Another embodiment of an electrical plug according to the present invention is illustrated in FIGS. 10 through 13. The alternative form of electrical plug shown in FIGS. 10 through 13 is designated generally by reference numeral 210. The elements of this alternative from of electrical plug that are identical or functionally analogous to those components mentioned above with respect to electrical plug 10 are designated by reference numerals identical to those used above with the exception that this embodiment uses reference numerals in the 200 series.

The electrical plug 210 includes a plug body 212 having a peripheral edge 218 extending thereabout. The plug body 212 defines a socket 219 including conventional electrical contacts 220 and 222. Each electrical contact 220, 222 includes conventional electrically conductive members 224 and 226 embedded within the plug body 212 of plug 210. As well known in the art, the members 224, 226 of each electric contact 220, 222 are spring biased toward each other but are separatable from each other when a male conductive pin of another electrical plug 250 is inserted therebetween. The conductive members 224, 226 of each electric contact 220, 222 are operably and electrically connected in a conventional manner to an electrical cord or conductor 230 extending away from the peripheral edge 218 of the plug body 212 of electric plug 210.

The plug body 212 includes a first strain relief 240 arranged lengthwise along the peripheral edge 218 of the plug body 212. As shown, the strain relief 240 defines an elongated channel or groove 242 for accommodating a lengthwise portion of an electrical cord or conductor 252 operably associated with the electric plug 250. The strain relief 240 preferably includes a plurality of tines or extensions 260, 262 and 264 which combine with each other to defined a circuitous path 246 for the lengthwise portion of the electrical cord 252 entrapped therewithin. As shown, the circuitous path defined by the tines 260, 262 and 264 preferably configures the electrical cord entrapped therewith into other than a straight line. The tines 260, 262 and 264 and the channel or groove 242 defined thereby are substantially similar to those described above regarding tines 60, 62 and 64 and the channel 42 defined thereby.

In this form of the invention, a second strain relief 240' is also arranged on the plug body 212. The second strain relief 240' is substantially similar to the strain relief 240 disposed on an opposite side of the plug body 212. As shown, the elongated channel or groove 242 of strain relief 240 extends generally parallel to an elongated channel or groove 242' defined by strain relief 240' for capturing a lengthwise portion of a third electrical cord or conduit 252' passing adjacent to the plug body 212 of electric plug 210.

As will be appreciated, both strain reliefs 240 and 240' are preferably configured with structure 270 for releasably holding the respective lengthwise portion of electric cables 252 and 252' therewithin as discussed in detail above. Moreover, both strain reliefs 240 and 240' are preferably configured with structure 280 for releasably holding the respective lengthwise portion of electric cable 252 and 252' adjacent the peripheral edge 218 of the plug body 212 of electric cord 210 thereby reducing the effect tensile or pulling forces can have on the electric cords thereby inhibiting inadvertent separation of electric plugs from the plug body 212 of electric plug 210.

Figure 14:
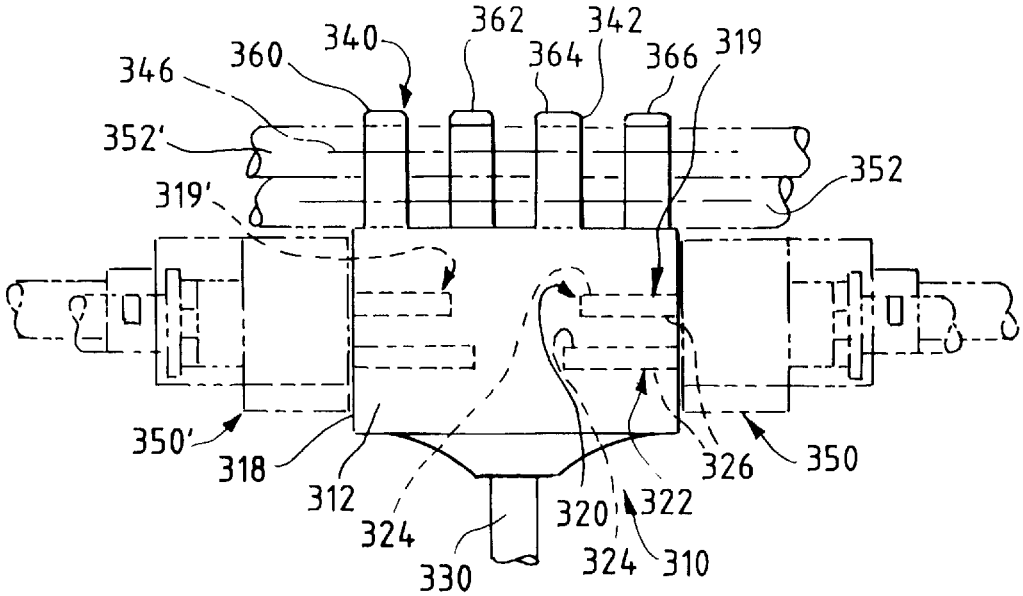
FIG. 14 is a plan view of still another form of electrical plug according to the present invention.
Figure 15:
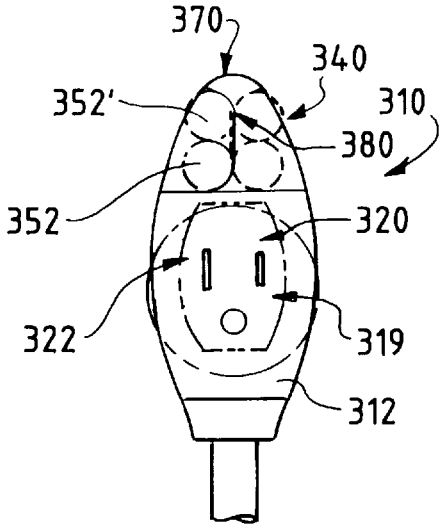
FIG. 15 is a left end elevational view of the electrical plug illustrated in FIG. 14.

Another embodiment of an electrical plug according to the present invention is illustrated in FIGS. 14 and 15. The alternative form of electrical plug shown in FIGS. 14 and 15 is designated generally by reference numeral 310. The elements of this alternative form of electrical plug that are identical or functionally analogous to those components mentioned above with respect to electrical plug 10 are designated by reference numerals identical to those used above with the exception that this embodiment uses reference numerals in the 300 series.

The electrical plug 310 includes a plug body 312 having a peripheral edge 318 extending thereabout. The plug body 312 defines a pair of sockets 319 and 319' disposed in substantially the same plane relative to each other and about the peripheral edge 318 of the plug body 312. In the illustrated form of the invention, the sockets 319 and 319' are disposed in diametrically opposed relation relative to each other. It should be appreciated, however, that other arrangements of the sockets 319 and 319' would equally suffice without detracting or departing from the spirit and scope of the present invention.

As shown in FIG. 14, each electrical socket 319 and 319' includes conventional electrical contacts 320 and 322. Each electrical contact 320, 322 includes conventional electrically conductive members 324 and 326 embedded within the plug body 312 of plug 310 as is well known in the art. As well known in the art, the members 324, 326 of each electric contact 320, 322 are spring biased toward each other but are separatable from each other when a male conductive pin of another electrical plug 350 or 350' is inserted therebetween.

The conductive members 324, 326 of each electric contact 320, 322 of electrical socket 319 are operably and electrically connected in a conventional manner to an electrical cord or conductor 330 extending away from the peripheral edge 318 of the plug body 312 of electric plug 310. Similarly, the conductive members 324, 326 of each electric contact 320, 322 of electrical socket 319' are likewise operably and electrically connected in a conventional manner to the electrical cord or conductor 330 extending away from the peripheral edge 318 of the plug body 312 of electric plug 310.

The plug body 312 includes a strain relief 340 arranged lengthwise along the peripheral edge 318 of the plug body 312. As shown, the strain relief 340 defines an elongated channel or groove 342 for accommodating lengthwise portions of electrical cords or conductors 352 and 352' operably associated with the electric plugs 350 and 350'. The strain relief 340 preferably includes a plurality of tines or extensions 360, 362, 364 and 366 which combine with each other to defined a circuitous path 346 for the lengthwise portions of the electrical cords 352 and 353' entrapped therewithin. As shown, the circuitous path 346 defined by the tines 360, 362 and 364 preferably configures the electrical cord entrapped therewith into a generally V-shape. The tines 360, 362 and 364 and the channel or groove 342 defined thereby are substantially similar to those described above regarding tines 60, 62 and 64 and the channel 42 defined thereby. In this form of the invention, the strain relief 340 is sized such that the lengthwise portions of the electrical cords or cables entrapped therewithin are arranged in a side-by-side relation relative to each other as specifically illustrated in FIGS. 14 and 15.

In this form of the invention, the elongated channel or groove 342 of strain relief 340 extends generally parallel to the electrical contacts 320, 322 defined by sockets 319 and 319'. As will be appreciated, strain relief 340 is preferably configured with structure 370 for releasably holding the respective lengthwise portion of electric cable 352 and 352' therewithin as discussed in detail above. Moreover, strain relief 340 is preferably configured with structure 380 for releasably holding the respective lengthwise portion of electric cable 352 and 352' adjacent the plug body 312 of electric plug 210 thereby reducing the effect tensile or pulling forces can have on the electric cords thereby inhibiting inadvertent separation of electric plugs from the plug body 312 of electric plug 310.

Figure 16:
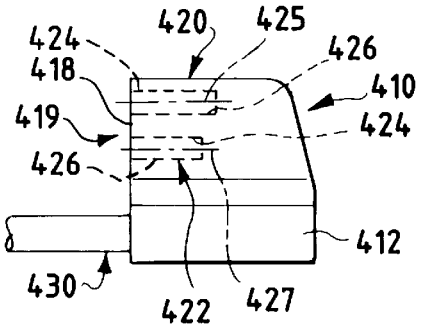
FIG. 16 is a plan view of another form of electrical plug according to the present invention.

Another embodiment of an electrical plug according to the present invention is illustrated in FIG. 16. The alternative form of electrical plug shown in FIG. 16 is designated generally by reference numeral 410. The elements of this alternative from of electrical plug that are identical or functionally analogous to those components mentioned above with respect to electrical plug 10 are designated by reference numerals identical to those used above with the exception that this embodiment uses reference numerals in the 400 series.

The electrical plug 410 includes a plug body 412 substantially similar to that disclosed above regarding plug body 12. In this embodiment of the invention, the plug body 412 defines an electrical socket 419 including electrical contacts 420, 422. Each electrical contact 420, 422 includes conventional electrically conductive members 424 and 426 embedded within the plug body 412 of plug 410. As well known in the art, the members 424, 426 of each electric contact 420, 422 are spring biased toward each other but are separatable from each other when a male conductive pin of another electrical plug is inserted therebetween. The conductive members 424, 426 of each electric contact 420, 422 are operably and electrically connected in a conventional manner to an electrical cord or conductor 430 extending away from the peripheral edge 418 of the plug body 12 of electric plug 410.

Notably, each contact 420, 422 has an elongated formation which define axes 425, 427 for the contacts 420, 422, respectively. As shown in FIG. 16, the electrical cord or conductor 430 preferably extends from the peripheral edge 418 of the plug body 412 in the same plane as the electrical contacts 420, 422, respectively. As shown in the drawing, at least that portion of the electrical cord 430 immediately adjacent the plug body 412 extends in a predetermined direction or path from the electrical plug 410.

The electrical cord 430 extending from the plug body 412 and the axes 425, 427 defined by the electrical contacts 420, 422 define an included angle of less than 180° therebetween. As will be described in detail hereinafter, and in connection with another form of the present invention, the included angle of less than 180° between the electrical cord 430 and the axes 425, 427 of the electrical contacts serves to retain an electrical connection between a male plug and the female plug 410. As such, when a pulling force or tensile stresses are imparted to the electrical cord associated with the male plug electrically joined to the female plug 410, the plugs are drawn into engagement relative to each other thereby enhancing the electrical connection established therebetween.

Figure 17:
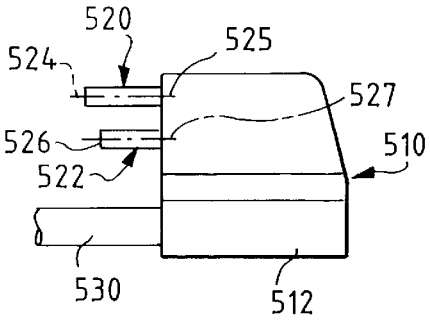
FIG. 17 illustrates an electrical plug assembly including the electrical plug shown in FIG. 16 joined or connected to an electric plug at the end of an electrical cord.

Another embodiment of an electrical plug according to the present invention is illustrated in FIG. 17. The alternative form of electrical plug shown in FIG. 17 is designated generally by reference numeral 510. The elements of this alternative from of electrical plug that are identical or functionally analogous to those components mentioned above with respect to electrical plug 10 are designated by reference numerals identical to those used above with the exception that this embodiment uses reference numerals in the 500 series.

The electrical plug 510 includes a plug body 512 substantially similar to that disclosed above regarding plug body 12. In this embodiment of the invention, the plug body 512 defines at least two electrical contacts 520, 522. The electrical contact 520, 522 are shown as including conventional electrically conductive pin members 524 and 526 a linear portion of each being embedded within the plug body 512 of plug 510. As well known in the art, the pin members 524, 526 of the electric contact 520, 522 are operably and electrically connected in a conventional manner to an electrical cord or conductor 530 extending away from the peripheral edge 518 of the plug body 512 of electric plug 510.

Notably, each contact 520, 522 has an elongated formation which define axes 525, 527 for the contacts 520, 522, respectively. As shown in FIG. 17, the electrical cord or conductor 530 preferably extends from the peripheral edge 518 of the plug body 512 in the same plane as the electrical contacts 520, 522, respectively. As shown in the drawing, at least that portion of the electrical cord 530 immediately adjacent the plug body 512 extends in a predetermined direction or path from the electrical plug 510.

The electrical cord 530 extending from the plug body 512 and the axes 525, 527 defined by the electrical contacts 520, 522 define an included angle of less than 180° therebetween. As will be described in detail hereinafter, the included angle of less than 180° between the electrical cord 530 and the axes 525, 527 of the electrical contacts serves to retain an electrical connection between the male plug 510 and a female plug. As such, when a pulling force or tensile stresses are imparted to the electrical cord associated with the female plug electrically joined to male plug 510, the plugs are drawn into engagement relative to each other thereby enhancing the electrical connection established therebetween.

Figure 18:
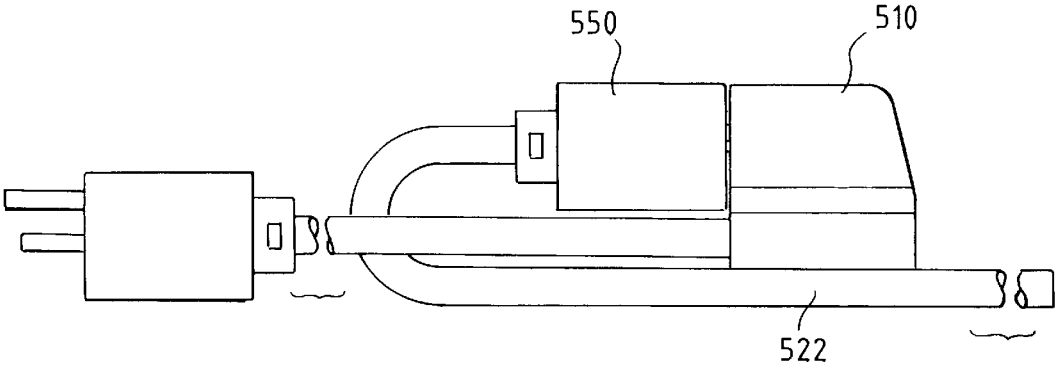
FIG. 18 is a side elevational view of the electrical plug assembly shown in FIG. 17.
Figure 19:
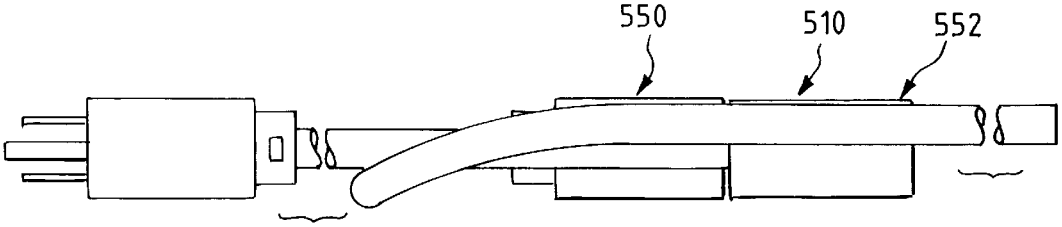
FIG. 19 is a plan view of still another form of electrical plug according to the present invention.

The advantages of the plug designs illustrated in FIGS. 16 and 17 is illustrated in FIGS. 18 and 19. Since the plug designs illustrated in FIGS. 16 and 17 are substantially similar, except for the formation of the electrical contacts on the plug body, a description of only plug 510 will be provided with the understanding that the other plug 410 has similar advantages thereto. As shown, when plug 510 is electrically connected to another electrical plug 550, the plugs are disposed relative to each other such that a pulling to tensile force applied to the electrical cord 552 will tend to draw the plugs 510 and 550 into engagement relative to each other thereby enhancing the electrical connection therebetween. The ability to draw the electrical plugs 510 and 550 toward each other is provided since the included angle between the electrical contacts 520, 522 and the direction the electrical cord extends from the peripheral edge 518 of the plug body is less than 180°.

One aspect of the present invention relates to the strain relief advantageously disposed on the plug body of the electric plug. The strain relief is configured to accommodate a lengthwise portion of an electrical cord therewithin in a manner inhibiting the lengthwise segment of electrical cord from moving endwise. Accordingly, when tensile forces or pulling is inadvertently exerted onto the cord, the strain relief inhibits the electrical cord from disconnecting the electrical connection between the plug disposed at the free end of the cord and the electrified plug of the present invention. Moreover, the strain relief is configured to allow different sized electrical cords to be threaded therethrough in different direction while allowing for the same benefits to be accomplished—inhibiting the cord from moving endwise through the strain relief. Moreover, the strain relief can be configured to accommodate cords in side-by-side relation relative to each other if so required. Alternatively, the electrical plug of the present invention can be configured with dual socket receptacles and one or more strain reliefs for accommodating a lengthwise portion of each electrical cord connected thereto.

Another salient feature of the present invention relates to the electrical plug of the present invention being configured such that the axes of the electrical contacts associated with the electrical plug and the direction which the electrical cord extending from the plug body are disposed relative to each other such that an included angle of less than 180° is disposed therebetween. As such, when pulling or tensile forces are exerted on the electrical cord electrically joined to the plug of the present invention, the electric plugs which are joined in an electrical connection are drawn together rather than pulled apart.

From the foregoing it will be observed that numerous modifications and variations can be effected without departing or detracting from the true spirit and scope of the novel concept of the present invention. It will be appreciated that the present disclosure is intended to set forth exemplifications of the invention which are not intended to limit the invention to the specific embodiments illustrated. The disclosure is intended to cover by the appended claims all such modifications as fall within the spirit and scope of the claims.

What is claimed is:

1. An electrical plug, comprising:

a plug body adapted for connection to electricity through a first electrical cord extending therefrom, said plug body defining a channel for accommodating a lengthwise portion of a second electrical cord, said channel being configured to inhibit the lengthwise portion of said second electrical cord accommodated therewithin from passing endwise through the channel when a pulling force is exerted thereon.

2. An electrical plug, comprising:

a plug body adapted for connection to electricity through a first electrical cord extending therefrom, said plug body defining a channel for accommodating a lengthwise portion of a second electrical cord, said channel being configured to inhibit the lengthwise portion of said second electrical cord accommodated therewithin from passing endwise through the channel when a pulling force is exerted thereon, wherein said channel includes ingress and egress portions disposed substantially coplanar relative to each other and a midportion which is offset from the ingress and egress end portions such that the lengthwise portion of electrical cord passing therethrough is inhibited from endwise movement therethrough.

3. The electrical plug according to claim 1 wherein said plug body has spaced apart and opposed surfaces and a peripheral edge extending between said surfaces, and wherein said channel extends along a lengthwise portion of the peripheral edge of said plug body.

4. The electrical plug according to claim 1 wherein said channel is defined by extensions projecting from a peripheral edge of said plug body.

5. The electrical plug according to claim 4 wherein said plug body is one-piece construction with said extensions being formed integrally therewith.

6. The electrical plug according to claim 1 further including structure for holding the lengthwise portion of said second electrical cord adjacent said plug body.

7. The electrical plug according to claim 1 further including structure for releasably holding the lengthwise portion of the second electrical cord within said channel.

8. The electrical plug according to claim 1 further including conductive pins operably connected to said first electrical cord and extending from said plug body.

9. An electrical plug, comprising:

an electrifiable plug body having electrical contacts for electrically connecting said plug body to another electrical plug having an electrical cord, and wherein said plug body defines a strain relief for releasably securing a lengthwise portion of said electrical cord to the plug body thereby inhibiting tensile forces applied to said electrical cord from effecting separation between the electrical cord and the electrical contacts of said plug body, wherein said strain relief comprises an elongated channel defined on said plug body for accommodating a lengthwise portion of the electrical cord therewithin, said channel having ingress and egress end portions in substantial alignment to each other and a midportion arranged in offset relation relative to said ingress and egress portions and being configured to allow insertion of said electrical cord into said channel exteriorly of said plug body for inhibiting endwise movement of said electrical cord through said channel when a pulling force is exerted onto said electrical cord.

10. The electrical plug according to claim 9 wherein said strain relief is comprised of a series of tines projecting from said plug body and which, in combination with each other, define a circuitous path for the lengthwise portion of said electrical cord.

11. The electrical plug according to claim 9 wherein said electrical contacts include at least two relatively rigid conductive pins extending in a first direction away from said plug body in generally parallel relation relative to each other.

12. The electrical plug according to claim 9 wherein said channel is elongated in a direction extending generally parallel to a longitudinal axis of the electrical contacts of said plug body.

13. The electrical plug according to claim 9 further including structure for holding the lengthwise portion of said electrical cord adjacent said plug body.

14. The electrical plug according to claim 9 further including structure for releasably holding the lengthwise portion of said electrical cord within said channel.

15. The electrical plug according to claim 9 wherein said strain relief is configured to releasably secure a lengthwise portion of a second electrical cord to the plug body.

16. An electrical plug assembly configured to mate with an electrical plug disposed at an end of an electrical cord, said plug assembly comprising:

a plug body having electrical contacts operably and electrically connected to a flexible electrical conductor extending from said plug body, said plug body further including a strain relief for gripping a lengthwise portion of the electrical cord passing adjacent said plug body thereby inhibiting relative movement between said lengthwise portion of the electrical cord and the plug body.

17. The electrical plug according to claim 16 wherein said strain relief comprises an elongated groove arranged on said plug body, said groove being defined by opposed surfaces which are sized and arranged relative to each other to grip the lengthwise portion of said electrical cord therebetween thus inhibiting endwise movement of the electrical cord through said groove.

18. The electrical plug assembly according to claim 17 wherein said electrical contacts each extend in a liner direction relative to said plug body and generally parallel relative to each other.

19. The electrical plug assembly according to claim 18 wherein said groove is elongated in generally the same linear direction as said electrical contacts.

20. The electrical plug assembly according to claim 18 wherein said elongated groove includes inlet and outlet end portions generally aligned relative to each other and a midportion arranged in offset relation relative to the end portions, and wherein said groove is elongated in generally the same linear direction as said electrical contacts whereby a loop is formed in that portion of the electrical cord between the outlet end portion of the elongated groove and the electrical plug after the electrical plug is mated with plug body of said electrical plug assembly.

21. The electrical plug assembly according to claim 17 wherein said elongated groove has ingress and egress end portions disposed in substantial alignment relative to each other and a midportion arranged in offset relation relative to said ingress and egress end portions.

22. The electrical plug assembly according to claim 20 wherein said strain relief comprises a series of tines projecting outwardly from said plug body and which, in combination with each other, define a circuitous path of travel for the lengthwise portion of the electrical cord gripped by said strain relief.

23. The electrical plug assembly according to claim 22 wherein said tines are formed integrally with said plug body.

24. The electrical plug assembly according to claim 20 wherein said strain relief includes structure for holding the gripped portion of electrical cord adjacent the plug body.

25. The electrical plug assembly according to claim 17 wherein said elongated groove opens along its entire length to one side of the plug body to promote insertion and removal of the electrical cord from the elongated groove.

26. An electrical plug configured to mate with another electrical plug having an electrical cord extending therefrom, said electrical plug comprising:

a plug body with a flexible electrical conductor extending therefrom, and a pair of electrical contacts operably connected to said electrical conductor, said electrical contacts operably engaging with other electrical connections on said another electrical plug when said plug body and said another electrical plug are mated relative to each other, wherein the electrical contacts on said plug body are arranged relative to said another electrical plug such that pulling forces exerted on either or both the electrical conductor or said other electrical connections will cause the plug body and said another electrical plug to be drawn toward engagement relative to each other, and wherein said plug body further includes a strain relief containing an open channel on said plug body having ingress and egress end portions disposed in substantial alignment relative to each other and a midportion arranged in offset relation to said ingress and egress end portions, for releasably accommodating a lengthwise portion of said electrical cord in a manner inhibiting endwise movement of the electrical cord through said channel in response to pulling forces being exerted upon said electrical cord thereby retaining said electrical plug in operable mating relationship with said plug body.

27. The electrical plug according to claim 26 wherein said plug body has spaced apart major surfaces and a peripheral edge adjoining said major surfaces, with said electrical contacts of the plug body and the electrical conductor being disposed on the peripheral edge of said plug body.

28. The electrical plug according to claim 26 wherein said plug body includes spaced apart top and bottom and a peripheral edge joined to the top and bottom surfaces, said peripheral edge defining a generally planar surface portion extending in a plane generally normal to said top and bottom surfaces, and wherein said electrical cord connected to said another electrical plug and said electrical contacts of said plug body extend generally normal to said plane.

29. The electrical plug according to claim 26 wherein said channel is elongated in generally the same direction as said electrical contacts.

30. The electrical plug according to claim 26 wherein said electrical contacts include two conductive pins projecting from said plug body.

31. The electrical plug according to claim 26 wherein said open channel includes inlet and outlet end portions generally aligned relative to each other and a midportion arranged in offset relation relative to the end portions, and wherein said channel is elongated in generally the same linear direction as said electrical contacts on said plug body whereby a loop is formed in that portion of the electrical cord passing between the outlet end portion of the elongated channel and said another electrical plug after said another electrical plug is connected to with the plug body.

32. The electrical plug according to claim 26 wherein said channel has ingress and egress end portions disposed in substantial alignment relative to each other and a midportion arranged in offset relation relative to said ingress and egress end portions.

33. The electrical plug according to claim 26 wherein said strain relief comprises a series of tines projecting outwardly from said plug body and which, in combination with each other, define an open channel through which a lengthwise portion of said electrical cord endwise extends.

34. The electrical plug according to claim 33 wherein said tines are formed integrally with said plug body.

35. The electrical plug according to claim 26 further including structure for holding the portion of electrical cord releasably secured by said strain relief adjacent the plug body.

36. The electrical plug according to claim 26 wherein said channel opens along its entire length to one side of the plug body to promote insertion and removal of the electrical cord from the channel.

* * * * *